US012359351B2

(12) United States Patent
Sun et al.

(10) Patent No.: US 12,359,351 B2
(45) Date of Patent: Jul. 15, 2025

(54) POLYAMIDE 5X STAPLE FIBER

(71) Applicants: Cathay Biotech Inc., Shanghai (CN); CIBT America Inc., Newark, DE (US); Cathay (Jinxiang) Biomaterial Co., Ltd., Shandong (CN)

(72) Inventors: Chaoxu Sun, Shanghai (CN); Xiaochen Xu, Shanghai (CN); Xiucai Liu, Shanghai (CN)

(73) Assignees: Cathay Biotech Inc., Shanghai (CN); CIBT America Inc., Newark, DE (US); Cathay (Jinxiang). Biomaterial Co., Ltd., Shandong (CN)

( * ) Notice: Subject to any disclaimer, the term of this patent is extended or adjusted under 35 U.S.C. 154(b) by 352 days.

(21) Appl. No.: 17/783,952

(22) PCT Filed: Jan. 15, 2020

(86) PCT No.: PCT/CN2020/072303

§ 371 (c)(1),
(2) Date: Jun. 9, 2022

(87) PCT Pub. No.: WO2021/142670

PCT Pub. Date: Jul. 22, 2021

(65) Prior Publication Data

US 2023/0012061 A1 Jan. 12, 2023

(51) Int. Cl.

| | |
|---|---|
| ***D01F 6/60*** | (2006.01) |
| ***D01D 4/02*** | (2006.01) |
| ***D01D 5/088*** | (2006.01) |
| ***D01D 5/26*** | (2006.01) |
| ***D02G 3/04*** | (2006.01) |
| ***D02G 3/44*** | (2006.01) |

(52) U.S. Cl.

CPC ..... *D02G 3/04* (2013.01); *D01D 4/02* (2013.01); *D01D 5/088* (2013.01); *D01D 5/26* (2013.01); *D01F 6/60* (2013.01); *D02G 3/445* (2013.01); *D10B 2211/02* (2013.01); *D10B 2331/02* (2013.01)

(58) Field of Classification Search

CPC ..... D02G 3/04; D02G 3/445; D01D 4/02; D01D 5/088; D01D 5/26; D10B 2211/02; D10B 2331/02; D06P 3/16; D06P 3/8209; D06P 1/39; D06P 3/241; D06P 3/82; D01F 6/60

USPC ..... 428/359

See application file for complete search history.

(56) References Cited

U.S. PATENT DOCUMENTS

2019/0010659 A1 1/2019 Keranen

FOREIGN PATENT DOCUMENTS

| | | | | | |
|---|---|---|---|---|---|
| CN | 101864632 | A | | 10/2010 | |
| CN | 103757745 | A | | 4/2014 | |
| CN | 103981737 | A | | 8/2014 | |
| CN | 106192029 | A | | 12/2016 | |
| CN | 106868623 | A | * | 6/2017 | ..... C08G 69/26 |
| CN | 106894106 | A | * | 6/2017 | ..... D01D 1/00 |
| CN | 110117834 | A | | 8/2019 | |
| CN | 110373736 | A | | 10/2019 | |
| CN | 110616471 | A | | 12/2019 | |
| CN | 110904524 | A | | 3/2020 | |
| JP | 2001279525 | A | | 10/2001 | |
| JP | 2009179899 | A | | 8/2009 | |
| JP | 2015105445 | A | | 6/2015 | |
| KR | 20140131968 | A | | 11/2014 | |

OTHER PUBLICATIONS

1st Office Action issued on May 18, 2023 for Japanese Patent Application No. 2022-533593 (5 pages).

International Search Report issued on Jul. 22, 2021 for International Patent Application No. PCT/CN2020/072303 (4 pages).

1st Office Action issued on Oct. 20, 2021 for Chinese Patent Application No. 201811085457.1 (16 pages).

English translation of Notice of Allowance for Korean Patent Application No. 10-2022-7018637, mailed on Nov. 6, 2024.

Extended European Search Report mailed on Jan. 28, 2025 in EP20914296.7.

* cited by examiner

*Primary Examiner* — Matthew D Matzek

(74) *Attorney, Agent, or Firm* — Fox Rothschild LLP

(57) ABSTRACT

The present disclosure provides a polyamide 5× staple fiber, a preparation method and use thereof. The polyamide 5× staple fiber has a denier of 8.0-30.0D, a breaking strength of 2.0-6.0 cN/dtex, and an elongation at break of 30-100%. The polyamide 5× staple fiber has good mechanical properties and softness, and a blended wool yarn for manufacturing carpets with good mechanical properties, dyeability, and wear resistance can be obtained by using the polyamide 5× staple fiber.

10 Claims, No Drawings

POLYAMIDE 5X STAPLE FIBER

CROSS REFERENCE TO RELATED APPLICATIONS

This application is a U.S. national phase of International Patent Application No. PCT/CN2020/072303, filed on Jan. 15, 2020, the disclosure of which is incorporated by reference herein in its entirety as part of the present application.

TECHNICAL FIELD

The present disclosure relates to fiber technology, in particular to a polyamide 5× staple fiber, a preparation method and a use thereof, and belongs to the field of textile technology.

BACKGROUND OF ART

Carpet is a floor covering made of natural fibers such as cotton, wool, silk, hemp or chemical synthetic fibers that are knitted, flocked or woven by manual or mechanical processes, and are mainly used in hotels, residences, exhibition halls, automobile, ship and aircraft interiors, stages, etc. According to different types of materials, carpets are divided into pure wool carpets, blended carpets, chemical fiber carpets, and plastic carpets.

Pure wool carpets are made of native wool, which has long fibers, high tensile force and good elasticity. It is the most ideal raw material for weaving carpets in the world, and are generally used in premium hotels, halls, stages and other aspects.

Blended carpets are made by adding chemical fibers to wool fibers, which combine the advantages of pure wool carpets and chemical fiber carpets.

Chemical fiber carpets, that is, carpets made of nylon materials, have good resilience, bulkiness and lodging resistance, as well as excellent wear resistance, stain resistance and dyeability, and have become one of the main varieties of tufted carpets in the world. Adding 20% nylon fiber to the pure wool carpet, the wear resistance of the carpet is five times higher than that of the pure wool carpet, and at the same time, it overcomes the shortcomings of chemical fiber carpets that are easy to absorb dust due to their electrostatic effect, and also overcomes the shortcomings of pure wool carpets that are easy to corrode. It has the advantages of heat preservation, wear resistance, insect resistance, and high strength. Secondly, due to its blending with nylon fibers, synthetic fibers have much lower price than that of wool, which greatly reduces the cost of yarns and broadens the application field of blended carpets. At the same time, nylon fiber has the characteristics of light weight, which is 25% lighter than wool. If nylon fiber is used in automobiles, high-speed railways, airplanes, ships and other fields, it can reduce the consumption of fuel oil, pollution and carbon emissions, and nylon fiber has good dyeability, which can be dyed in the same bath with wool, and the carpet thus prepared is rich in color.

SUMMARY OF THE INVENTION

The present disclosure provides a polyamide 5× staple fiber, a preparation method and a use thereof, and the polyamide 5× staple fiber has good mechanical properties and softness.

The present disclosure provides a polyamide 5× staple fiber, said polyamide 5× staple fiber has a denier of 8.0-30.0D, a breaking strength of 2.0-6.0 cN/dtex, and an elongation at break of 30%-100%.

Due to the relatively large denier of the polyamide 5× staple fiber of the present application, the strength is higher and the mechanical properties are good.

Further, the polyamide 5× staple fiber has a dry heat shrinkage of 3.0%-12.0%, and an initial modulus of 20-50 cN/dtex.

Due to the relatively small initial modulus of the polyamide 5× staple fiber of the present application, it also has certain softness.

Further, the polyamide 5× staple fiber comprises at least one of polyamide 56 staple fiber, polyamide 510 staple fiber and polyamide 512 staple fiber. When the polyamide 5× staple fiber is a mixture of the above-mentioned types of staple fibers, the present disclosure does not limit the ratio between the individual staple fibers.

It is conceivable that the specific type of polyamide 5× staple fiber is related to the raw material from which the polyamide 5× staple fiber is made. For example, if the raw material for its preparation is polyamide 56, then polyamide 56 staple fiber is obtained.

Further, the polyamide 5× staple fiber of the present disclosure is derived from the product obtained by polymerization of 1,5-pentamethylenediamine and dibasic acid, followed by hot-melting and spinning.

Wherein, a polyamide 5× melt is derived from the polymerization reaction of 1,5-pentamethylenediamine and the dibasic acid, and the polyamide 5× melt is sequentially subjected to spinning to obtain the polyamide 5× staple fiber of the present disclosure.

The dibasic acid comprises at least one of C6-20 aliphatic dibasic acids, specifically, the dibasic acid comprises adipic acid, sebacic acid, undecanediacid, dodecanediacid, tridecanediacid, tetradecanediacid, pentadecanediacid, hexadecanediacid, heptadecanediacid, octadecanediacid, maleic acid and Δ9-1, 18 octadecene dibasic acid.

In the preparation of polyamide 5×, in addition to the above-mentioned 1,5-pentanediamine and dibasic acid, comonomers and/or additives can also be used as raw materials.

Wherein, the comonomer is selected from one or more of ethylenediamine, hexamethylenediamine, cyclohexanediamine, xylylenediamine, 6-aminocaproic acid, 11-aminoundecanoic acid, 12-aminododecanoic acid, p-aminomethyl benzoic acid, caprolactam and ω-laurolactam;

The additives are selected from one or more of matting agents, flame retardants, antioxidants, ultraviolet absorbers, infrared absorbers, crystal nucleating agents, fluorescent whitening agents and antistatic agents.

The present disclosure also provides a preparation method of any of the above-mentioned polyamide 5× staple fibers, comprising the following steps:

1) After being ejected through the spinneret orifices of the spinneret in the spinning manifold, the polyamide 5× melt is sequentially subjected to cooling and pre-spinning treatment to obtain the Un-drawn yarn (UDY);

2) Post-processing the UDY to obtain the polyamide 5× fiber;

wherein, the number of holes of the spinneret is 100-500f, and the diameter of the spinneret orifices is 1.02-1.50 mm.

Compared with the existing technology, the number of holes in the disclosed spinneret is smaller, and the diameter is larger than the existing technology, and the pre-spinning speed is reduced to a certain extent, thus helping to improve the denier of polyamide 5× fiber.

In step 1), the pre-spinning speed of the pre-spinning treatment is 100-480 m/min.

In addition, the cooling is performed by using a ring blower, and the wind temperature of the ring blower is 15-32° C., and the wind speed of the ring blower is 0.2-1.0 m/s.

After the polyamide 5× melt is ejected through the spinneret orifice, the cooling conditions are related to the arrangement of fiber molecules within the melt. When the melt is cooled by ring blower at a wind temperature of 15-32° C. and wind speed of 0.2-1.0 m/s, it is helpful to generate the UDY with high denier.

In step 2), the post-processing successively includes a drawing treatment, a curling treatment, a relaxation heat-setting treatment and a cutting treatment, thereby obtaining polyamide 5× staple fibers. Among them, drawing treatment, curling treatment, and relaxation heat-setting treatment are extremely important.

The drawing process specifically refers to drawing the UDY to make it reach the target length. When preparing polyamide 5× staple fiber in the present disclosure, the temperature of the drawing treatment is 50-120° C., and the draw ratio is 2-4 times, that is, when the length after drawing is 2 to 4 times the length before drawing, the drawing can be stopped.

In addition, the temperature of the curling treatment is 50-100° C., and the temperature of the relaxation heat-setting is 60-150° C. Specifically, the curling treatment refers to preheating the UDY obtained after drawing through a steam heating box and then entering the curling machine.

Hereinafter, the preparation method of the polyamide 5× melt is introduced in detail. The polyamide 5× melt of the present disclosure can be prepared by the following steps: Mixing 1,5-pentamethylenediamine, dibasic acid and water under nitrogen protection, heating to 210-250° C. in an oil bath, and start venting when the pressure rises above 1.0 MPa. When the temperature in the kettle reaches above 250° C., vacuumize to −0.01-0.1 MPa, keep under vacuum for 5-60 min to obtain the polyamide 5× melt.

The polyamide 5× melt can be directly used for spinning, namely: melt direct spinning. Alternatively, the polyamide 5× melt can also be prepared by heating and melting polyamide 5× resin chips to prepare the polyamide 5× melt. The polyamide 5× resin can be obtained commercially, or the polyamide 5× melt can be obtained by the aforementioned method, and then cooled and pelletized to prepare the polyamide 5× resin. Namely: chip spinning.

Wherein, the relative viscosity of the polyamide 5× chip is 2.5-2.8. The moisture content of the polyamide 5× chip is less than or equal to 1000 ppm.

If the raw material for preparing polyamide 5× melt also includes comonomers and/or additives, comonomers and/or additives need to be added before heating and pressurization.

The present disclosure also provides a blended wool yarn, comprising 5-50 parts by weight of any of the above-mentioned polyamide 5× staple fiber and 50-95 parts by weight of wool.

That is, the blended wool yarn is prepared by blending any of the above-mentioned polyamide 5× staple fiber and wool. In the preparation process, when the woolen spinning process is adopted, the blended wool yarn is specifically a carded wool yarn; when a semi-worsted spinning process is adopted, the blended wool yarn is specifically a semi-worsted yarn.

Further, the blended wool yarn meets the following parameters:

when the blended wool yarn is a carded wool yarn, said carded wool yarn has a hank strength F1, and F1≥60N/5 m; and/or, when the blended wool yarn is a semi-worsted yarn, said semi-worsted yarn has a a hank strength F2, and F2≥200N/5 m; and/or, the dye uptake of the acid dye of the blended wool yarn for one-bath dyeing is a, and a≥90%; and/or the K/S value of the acid dye of the blended wool yarn for one-bath dyeing is b, and b≥10; and/or, the dye-leveling value of the acid dye of the blended wool yarn for one-bath dyeing is S, and S≤0.2; and/or, the color fastness to dry rubbing of the blended wool yarn is c1, and c1≥3, and the color fastness to wet rubbing of the blended wool yarn is c2, and c1≥3; and/or, the color change fastness of the acid dye of the blended wool yarn for one-bath dyeing and soaping is d1, and d1≥grade 4, and the staining fastness of the acid dye of the blended wool yarn for one-bath dyeing and soaping is d2, and d2≥grade 3.

Among them, one-bath dyeing condition of the acid dye of the blended wool yarn is as follows: the concentration of the acid dye is 0.5-8.0%, the dyeing temperature is 80-100° C., the pH value of the dyeing solution is 4-7, and the concentration of the dye inhibitor is 1-10%. The present disclosure also provides a preparation method of any of the above-mentioned blended wool yarn, the preparation method comprises the following steps: mixing the polyamide 5× staple fiber with wool, followed by sequentially subjected to carding, fine spinning, post-processing and spinning, to obtain the blended wool yarn that comprises the 5-50 parts by weight of polyamide 5× staple fiber, and 50-95 parts by weight of wool.

Specifically, when the spinning process is a woolen spinning process, the carded wool yarn is prepared; when the spinning process is a semi-worsted spinning process, a semi-worsted yarn is prepared.

The present disclosure also provides the use of any of the above-mentioned blended wool yarn in carpets.

Specifically, the blended wool yarn can be used to prepare handmade carpets and machine-made carpets. Among them, woven carpets include but are not limited to tufted carpets, patchwork carpets, Wilton carpets and Axminster carpets.

The implementation of the present disclosure has at least the following advantages:

1. The polyamide 5× staple fiber of the present disclosure has good mechanical properties and softness, and its denier can reach 8.0-30.0D;

2. The raw materials for production the polyamide 5× staple fiber of the present disclosure use non-petroleum-based materials, that is, bio-based materials, which are not dependent on petroleum resources, are environmentally friendly, do not cause serious pollution, and can reduce carbon dioxide emissions and inhibit greenhouse effect;

3. The blended wool yarn of the invention of the present disclosure has good mechanical properties, wear resistance and dyeability, and is dyed in the same bath with acid dyes, with good color uniformity and no color difference;

4. In the application of the carpet field, the blended wool yarn of the present disclosure not only has the characteristics of light weight and wear resistance, but also can greatly reduce the cost for production of raw materials.

DETAILED DESCRIPTION

In order to make the objectives, technical solutions and advantages of the present disclosure clearer, the technical solutions in the embodiments of the present disclosure will be clearly and completely described below with reference to the embodiments of the present disclosure. Obviously, the described embodiments are part, but not all, of the embodiments of the present disclosure. Based on the embodiments in the disclosure, all other embodiments obtained by those skilled in the art without making creative work shall falls within the protection scope of the present disclosure.

Example 1

The polyamide 56 staple fiber of this example was prepared as follows:

1) After being ejected through the spinneret orifices of the spinneret in the spinning manifold, the polyamide 56 melt was sequentially subjected to cooling and pre-spinning to obtain the UDY;

wherein, the cooling was performed by using a ring blower, and the wind temperature of the ring blower was 28° C., and the wind speed of the ring blower was 0.5 m/s;

the number of spinneret orifices was 260f, the diameter of the spinneret orifices was 1.05 mm, the pre-spinning speed was 300 m/min;

2) the UDY were subjected to post-processing to obtain the polyamide 56 staple fiber;

The post-processing includes the following steps: subjecting the UDY to a drawing treatment, a curling treatment, a relaxation heat-setting treatment and a cutting treatment, wherein, the draw ratio was 3 times, the drawing temperature was 100° C., the curling temperature was 80° C., and the temperature during relaxation heat-setting was 130° C.

In this example, the polyamide 56 melt was prepared as follows: heating the polyamide 56 chips to a molten state to obtain a polyamide 56 melt; wherein, the moisture content of the polyamide 56 chips was 300 ppm, and the relative viscosity of the polyamide 56 chips was 2.5.

In this example, the relative viscosity of polyamide 56 chips was tested as follows: The relative viscosity of polyamide 5× resin was measured by the concentrated sulfuric acid method using the Ubbelohde viscometer, and the steps are as follows:

after drying, 0.25±0.0002 g polyamide 5× resin sample was accurately weighed and dissolved by adding 50 mL concentrated sulfuric acid (96%). The flow time of concentrated sulfuric acid to and the flow time of the sample solution of polyamide 5× bulk continuous filament (BCF) t were measured and recorded in a water bath at constant temperature of 25° C.

The formula for calculating relative viscosity is: relative viscosity $VN=t/t_0$;

t—flow time of the solution;

$t_0$—flow time of solvent.

The moisture content of the polyamide 56 chips in this example was tested as follows:

It was determined by Karl Fischer moisture titrimeter.

Example 2

The polyamide 56 staple fiber of this example was prepared as follows:

1) After being ejected through the spinneret orifices of the spinneret in the spinning manifold, the polyamide 56 melt was sequentially subjected to cooling and pre-spinning to obtain the UDY;

wherein, the cooling was performed by using a ring blower, and the wind temperature of the ring blower was 23° C., and the wind speed of the ring blower was 0.6 m/s;

the number of spinneret orifices was 250f, the diameter of the spinneret orifices was 1.1 mm, the pre-spinning speed was 200 m/min;

2) the UDY were subjected to post-processing to obtain the polyamide 56 staple fiber;

The post-processing includes the following steps: subjecting the UDY to a drawing treatment, a curling treatment, a relaxation heat-setting treatment and a cutting treatment, wherein, the draw ratio was 2.8 times, the drawing temperature was 60° C., the curling temperature was 90° C., and the temperature during relaxation heat-setting is 120° C.

In this example, the polyamide 56 melt was prepared as follows: heating the polyamide 56 chips to a molten state to obtain a polyamide 56 melt; wherein, the moisture content of the polyamide 56 chips was 500 ppm, and the relative viscosity of the polyamide 56 chips was 2.6.

The relative viscosity and moisture content of polyamide 56 chips were determined in the same manner as in Example 1.

Example 3

The polyamide 56 staple fiber of this example was prepared as follows:

1) After being ejected through the spinneret orifices of the spinneret in the spinning manifold, the polyamide 56 melt was sequentially subjected to cooling and pre-spinning to obtain the UDY;

wherein, the cooling was performed by using a ring blower, and the wind temperature of the ring blower was 25° C., and the wind speed of the ring blower was 0.8 m/s;

the number of spinneret orifices was 200f, the diameter of the spinneret orifices was 1.02 mm, the pre-spinning speed was 350 m/min;

2) the UDY were subjected to post-processing to obtain the polyamide 56 staple fiber;

The post-processing includes the following steps: subjecting the UDY to a drawing treatment, a curling treatment, a relaxation heat-setting treatment and a cutting treatment, wherein, the draw ratio was 3.2 times, the drawing temperature was 70° C., the curling temperature was 90° C., and the temperature during relaxation heat-setting is 140° C.

In this example, the polyamide 56 melt was prepared as follows: heating the polyamide 56 chips to a molten state to obtain a polyamide 56 melt; wherein, the moisture content of the polyamide 56 chips was 600 ppm, and the relative viscosity of the polyamide 56 chips was 2.7.

The relative viscosity and moisture content of polyamide 56 chips were determined in the same manner as in Example 1.

Example 4

The polyamide 56 staple fiber of this example was prepared as follows:

1) After being ejected through the spinneret orifices of the spinneret in the spinning manifold, the polyamide 56 melt was sequentially subjected to cooling and pre-spinning to obtain the UDY;

wherein, the cooling was performed by using a ring blower, and the wind temperature of the ring blower was 22° C., and the wind speed of the ring blower was 0.7 m/s;

the number of spinneret orifices was 150f, the diameter of the spinneret orifices was 1.2 mm, the pre-spinning speed was 280 m/min;

2) the UDY were subjected to post-processing to obtain the polyamide 56 staple fiber;

The post-processing includes the following steps: subjecting the UDY to a drawing treatment, a curling treatment, a relaxation heat-setting treatment and a cutting treatment, wherein, the draw ratio was 2.9 times, the drawing temperature was 85° C., the curling temperature was 95° C., and the temperature during relaxation heat-setting is 125° C.

In this example, the polyamide 56 melt was prepared as follows: heating the polyamide 56 chips to a molten state to obtain a polyamide 56 melt; wherein, the moisture content of the polyamide 56 chips was 800 ppm, and the relative viscosity of the polyamide 56 chips was 2.8.

The relative viscosity and moisture content of polyamide 56 chips were determined in the same manner as in Example 1.

Example 5

The polyamide 56 staple fiber of this example was prepared as follows:

1) After being ejected through the spinneret orifices of the spinneret in the spinning manifold, the polyamide 56 melt was sequentially subjected to cooling and pre-spinning to obtain the UDY;

wherein, the cooling was performed by using a ring blower, and the wind temperature of the ring blower was 26° C., and the wind speed of the ring blower was 0.4 m/s;

the number of spinneret orifices was 180f, the diameter of the spinneret orifices was 1.05 mm, the pre-spinning speed was 180 m/min;

2) the UDY were subjected to post-processing to obtain the polyamide 56 staple fiber;

The post-processing includes the following steps: subjecting the UDY to a drawing treatment, a curling treatment, a relaxation heat-setting treatment and a cutting treatment, wherein, the draw ratio was 2.5 times, the drawing temperature was 70° C., the curling temperature was 70° C., and the temperature during relaxation heat-setting is 110° C.

In this example, the polyamide 56 melt was prepared as follows: heating the polyamide 56 chips to a molten state to obtain a polyamide 56 melt; wherein, the moisture content of the polyamide 56 chips was 200 ppm, and the relative viscosity of the polyamide 56 chips was 2.5.

The relative viscosity and moisture content of polyamide 56 chips were determined in the same manner as in Example 1.

Example 6

The polyamide 56 staple fiber of this example was prepared as follows:

1) After being ejected through the spinneret orifices of the spinneret in the spinning manifold, the polyamide 56 melt was sequentially subjected to cooling and pre-spinning to obtain the UDY;

wherein, the cooling was performed by using a ring blower, and the wind temperature of the ring blower was 23° C., and the wind speed of the ring blower was 0.5 m/s;

the number of spinneret orifices was 200f, the diameter of the spinneret orifices was 1.1 mm, the pre-spinning speed was 400 m/min;

2) the UDY were subjected to post-processing to obtain the polyamide 56 staple fiber;

The post-processing includes the following steps: subjecting the UDY to a drawing treatment, a curling treatment, a relaxation heat-setting treatment and a cutting treatment, wherein, the draw ratio was 3.0 times, the drawing temperature was 75° C., the curling temperature was 105° C., and the temperature during relaxation heat-setting is 135° C.

In this example, the polyamide 56 melt was prepared as follows:

Under nitrogen protection, 1,5-pentanediamine, adipic acid and water were mixed, followed by heating and pressurizing to obtain the polyamide 56 melt.

In the preparation of the polyamide 56 melt, a comonomer caprolactam was also used and included as raw material, which was added before heating and pressurizing, wherein the relative viscosity of the polyamide 56 was controlled to be 2.6.

The relative viscosity and moisture content of polyamide 56 chips were determined in the same manner as in Example 1.

Example 7

The polyamide 510 staple fiber of this example was prepared as follows:

1) After being ejected through the spinneret orifices of the spinneret in the spinning manifold, the polyamide 510 melt was sequentially subjected to cooling and pre-spinning to obtain the UDY;

wherein, the cooling was performed by using a ring blower, and the wind temperature of the ring blower was 24° C., and the wind speed of the ring blower was 0.6 m/s;

the number of spinneret orifices was 250f, the diameter of the spinneret orifices was 1.15 mm, the pre-spinning speed was 450 m/min;

2) the UDY were subjected to post-processing to obtain the polyamide 510 staple fiber;

The post-processing includes the following steps: subjecting the UDY to a drawing treatment, a curling treatment, a relaxation heat-setting treatment and a cutting treatment, wherein, the draw ratio was 2.8 times, the drawing temperature was 60° C., the curling temperature was 70° C., and the temperature during relaxation heat-setting is 130° C.

In this example, the polyamide 510 melt was prepared as follows: heating the polyamide 510 chips to a molten state to obtain a polyamide 510 melt; wherein, the moisture content of the polyamide 510 chips was 500 ppm, and the relative viscosity of the polyamide 510 chips was 2.7.

The relative viscosity and moisture content of polyamide 510 chips were determined in the same manner as in Example 1.

Example 8

The polyamide 512 staple fiber of this example was prepared as follows:

1) After being ejected through the spinneret orifices of the spinneret in the spinning manifold, the polyamide 512 melt was sequentially subjected to cooling and pre-spinning to obtain the UDY;

wherein, the cooling was performed by using a ring blower, and the wind temperature of the ring blower was 22° C., and the wind speed of the ring blower was 0.5 m/s;

the number of spinneret orifices was 200f, the diameter of the spinneret orifices was 1.04 mm, the pre-spinning speed was 300 m/min;

2) the UDY were subjected to post-processing to obtain the polyamide 512 staple fiber; The post-processing includes the following steps: subjecting the UDY to a drawing treatment, a curling treatment, a relaxation heat-setting treatment and a cutting treatment, wherein, the draw ratio was 2.9 times, the drawing temperature was 70° C., the curling temperature was 80° C., and the temperature during relaxation heat-setting is 120° C.

In this example, the polyamide 512 melt was prepared as follows: heating the polyamide 512 chips to a molten state to obtain a polyamide 512 melt; wherein, the moisture content of the polyamide 512 chips was 300 ppm, and the relative viscosity of the polyamide 512 chips was 2.8.

The relative viscosity and moisture content of polyamide 512 chips were determined in the same manner as in Example 1.

Example 9

This example provides a blended wool yarn (carded wool yarn and semi-worsted yarn), and the blended wool yarn was prepared by the following steps:

The polyamide 56 staple fiber obtained in Example 1 was mixed with wool, followed by subjected to carding, fine spinning, post-processing and woolen spinning, to obtain the carded wool yarn that comprises 10 parts by weight of polyamide 56 staple fiber, and 90 parts by weight of wool.

The polyamide 56 staple fiber obtained in Example 1 was mixed with wool, followed by subjected to carding, fine spinning, post-processing and semi-worsted spinning, to obtain the semi-worsted yarn that comprises 10 parts by weight of polyamide 56 staple fiber, and 90 parts by weight of wool.

Example 10

This example provides a blended wool yarn (carded wool yarn and semi-worsted yarn), and the blended wool yarn was prepared by the following steps:

The polyamide 56 staple fiber obtained in Example 2 was mixed with wool, followed by subjected to carding, fine spinning, post-processing and woolen spinning, to obtain the carded wool yarn that comprises 20 parts by weight of polyamide 56 staple fiber, and 80 parts by weight of wool.

The polyamide 56 staple fiber obtained in Example 2 was mixed with wool, followed by subjected to carding, fine spinning, post-processing and semi-worsted spinning, to obtain the semi-worsted yarn that comprises 20 parts by weight of polyamide 56 staple fiber, and 80 parts by weight of wool.

Example 11

This example provides a blended wool yarn (carded wool yarn and semi-worsted yarn), and the blended wool yarn was prepared by the following steps:

The polyamide 56 staple fiber obtained in Example 3 was mixed with wool, followed by subjected to carding, fine spinning, post-processing and woolen spinning, to obtain the carded wool yarn that comprises 30 parts by weight of polyamide 56 staple fiber, and 70 parts by weight of wool.

The polyamide 56 staple fiber obtained in Example 3 was mixed with wool, followed by subjected to carding, fine spinning, post-processing and semi-worsted spinning, to obtain the semi-worsted yarn that comprises 30 parts by weight of polyamide 56 staple fiber, and 70 parts by weight of wool.

Example 12

This example provides a blended wool yarn (carded wool yarn and semi-worsted yarn), and the blended wool yarn was prepared by the following steps:

The polyamide 56 staple fiber obtained in Example 4 was mixed with wool, followed by subjected to carding, fine spinning, post-processing and woolen spinning, to obtain the carded wool yarn that comprises 35 parts by weight of polyamide 56 staple fiber, and 65 parts by weight of wool.

The polyamide 56 staple fiber obtained in Example 4 was mixed with wool, followed by subjected to carding, fine spinning, post-processing and semi-worsted spinning, to obtain the semi-worsted yarn that comprises 35 parts by weight of polyamide 56 staple fiber, and 65 parts by weight of wool.

Example 13

This example provides a blended wool yarn (carded wool yarn and semi-worsted yarn), and the blended wool yarn was prepared by the following steps:

The polyamide 56 staple fiber obtained in Example 5 was mixed with wool, followed by subjected to carding, fine spinning, post-processing and woolen spinning, to obtain the carded wool yarn that comprises 45 parts by weight of polyamide 56 staple fiber, and 55 parts by weight of wool.

The polyamide 56 staple fiber obtained in Example 5 was mixed with wool, followed by subjected to carding, fine spinning, post-processing and semi-worsted spinning, to obtain the semi-worsted yarn that comprises 45 parts by weight of polyamide 56 staple fiber, and 55 parts by weight of wool.

Example 14

This example provides a blended wool yarn (carded wool yarn and semi-worsted yarn), and the blended wool yarn was prepared by the following steps:

The polyamide 56 staple fiber obtained in Example 6 was mixed with wool, followed by subjected to carding, fine spinning, post-processing and woolen spinning, to obtain the carded wool yarn that comprises 30 parts by weight of polyamide 56 staple fiber, and 70 parts by weight of wool.

The polyamide 56 staple fiber obtained in Example 6 was mixed with wool, followed by subjected to carding, fine spinning, post-processing and semi-worsted spinning, to obtain the semi-worsted yarn that comprises 30 parts by weight of polyamide 56 staple fiber, and 70 parts by weight of wool.

Example 15

This example provides a blended wool yarn (carded wool yarn and semi-worsted yarn), and the blended wool yarn was prepared by the following steps:

The polyamide 510 staple fiber obtained in Example 7 was mixed with wool, followed by subjected to carding, fine spinning, post-processing and woolen spinning, to obtain the carded wool yarn that comprises 20 parts by weight of polyamide 510 staple fiber, and 80 parts by weight of wool.

The polyamide 510 staple fiber obtained in Example 7 was mixed with wool, followed by subjected to carding, fine spinning, post-processing and semi-worsted spinning, to obtain the semi-worsted yarn that comprises 20 parts by weight of polyamide 510 staple fiber, and 80 parts by weight of wool.

Example 16

This example provides a blended wool yarn (carded wool yarn and semi-worsted yarn), and the blended wool yarn was prepared by the following steps:

The polyamide 512 staple fiber obtained in Example 8 was mixed with wool, followed by subjected to carding, fine spinning, post-processing and woolen spinning, to obtain the carded wool yarn that comprises 30 parts by weight of polyamide 512 staple fiber, and 70 parts by weight of wool.

The polyamide 512 staple fiber obtained in Example 8 was mixed with wool, followed by subjected to carding, fine spinning, post-processing and semi-worsted spinning, to obtain the semi-worsted yarn that comprises 30 parts by weight of polyamide 512 staple fiber, and 70 parts by weight of wool.

Comparative Example 1

This comparative example provides a pure spinning wool yarn (carded wool yarn and semi-worsted yarn), and this pure spinning wool yarn was prepared by the following steps: The wool was subjected to carding, fine spinning, post-processing and woolen spinning, to obtain a carded wool yarn that comprises 100 parts by weight of wool.

Test Example 1

The following parameters were determined for the polyamide 5× staple fibers obtained from Examples 1-8, and the measurement results are shown in Table 1.

1. Denier:

In accordance with calculation by gravimetric method, a certain number of staple fibers were selected, combed neatly with a copper comb, cut to take 20 mm staple fibers, put on the cover glass, the number of fibers was counted on the projector, and the weight was finally measured with a torsion balance, and converted into weight of 10,000 m fibers.

2. Length:

It was determined in accordance with GB/T 14336.

3. Breaking Strength and Elongation at Break of Staple Fiber:

It was determined in accordance with GB/T 14337.

4. Dry Heat Shrinkage:

It was determined in accordance with FZ/T 50004, the heat treatment temperature is 180° C.

5. Initial Modulus:

The initial modulus is defined as the breaking strength when the elongation at break is 1%.

Test Example 2

The following parameters were measured for the blended wool yarn from Examples 9-16 and the pure spinning wool yarn from Comparative Example 1, and the measurement results are shown in Table 2.

1. Breaking Strength and Elongation at Break (a Hank Strength) of Blended Wool Yarn:

It was determined in accordance with GB/T 8696-1988.

2. Dye Uptake:

The change of dye concentration before and after dyeing was measured by spectrophotometer.

$$\text{dye uptake } (\%)=(A0-At)/A0\times 100\%;$$

wherein: A0 is the absorbance value of the characteristic absorption peak of the dye before treatment, and At is the absorbance value of the dye at the treatment time t.

3. K/S Value:

The K/S value of the dyed fabric was measured with a color measuring and color matching instrument using a computer, and the K/S value represented the apparent color depth value.

$$K/S=(1-R)^2/2R$$

wherein S is the dispersion coefficient, K is the absorption coefficient and R is the reflectivity.

4. Dye-Leveling Value S:

The sample was tested for leveling of dyeing in the color measuring and color matching instrument. One point in the sample was selected as the standard, and other positions in the sample were tested as the test sample. The color difference (ΔE) of the standard sample and the test sample was compared, and the leveling of dyeing of the fabric is calculated.

$$S=\sqrt{\frac{\sum_{1}^{N}\Delta E_i^2}{n}}$$

wherein, S is the standard deviation of the sample, ΔEi is the value of difference in color, and n is the number of tests.

5. Fastness to Soaping:

It was determined in accordance with GB/T 3921.1-1997.

6. Color Fastness to Rubbing:

It was determined in accordance with GB/T8427-1998.

TABLE 1

| | Denier (D) | Length (mm) | Breaking strength (CN/dtex) | Elongation at break (%) | Dry heat shrinkage (%) | Initial modulus (CN/dtex) |
|---|---|---|---|---|---|---|
| Example 1 | 15 | 120 | 4.5 | 68.5 | 6.5 | 40.5 |
| Example 2 | 10 | 150 | 4.8 | 75.6 | 7.8 | 38.5 |
| Example 3 | 20 | 110 | 3.5 | 80.5 | 8.2 | 39.8 |
| Example 4 | 18 | 90 | 4.9 | 90.4 | 7.2 | 42.3 |
| Example 5 | 8 | 100 | 5.0 | 65.5 | 7.9 | 40.2 |
| Example 6 | 12 | 120 | 4.2 | 72.3 | 6.9 | 38.5 |
| Example 7 | 15 | 100 | 4.6 | 62.8 | 5.8 | 35.4 |
| Example 8 | 18 | 120 | 4.2 | 70.5 | 6.2 | 32.3 |

TABLE 2

| | Hank strength (N/5 m) | | | | | Fastness to soaping (grade) | | Color fastness to rubbing (grade) | |
|---|---|---|---|---|---|---|---|---|---|
| | carded wool yarn | semi-worsted yarn | dye uptake (%) | K/S value | Leveling of dyeing S | color change | Staining | Dry rubbing | Wet rubbing |
| Example 9 | 65 | 212 | 97.8 | 15.8 | 0.12 | 4 | 3 | 4 | 3 |
| Example 10 | 68 | 223 | 98.2 | 16.4 | 0.18 | 5 | 4 | 4 | 4 |
| Example 11 | 70 | 231 | 99.2 | 20.5 | 0.16 | 4 | 4 | 5 | 3 |
| Example 12 | 64 | 213 | 96.5 | 30.4 | 0.14 | 4 | 3 | 4 | 3 |
| Example 13 | 82 | 220 | 97.2 | 22.8 | 0.17 | 5 | 3 | 5 | 4 |
| Example 14 | 75 | 235 | 96.3 | 29.6 | 0.12 | 5 | 4 | 4 | 3 |
| Example 15 | 76 | 234 | 94.3 | 22.6 | 0.15 | 4 | 4 | 5 | 4 |
| Example 16 | 72 | 220 | 95.2 | 21.9 | 0.18 | 4 | 4 | 4 | 3 |
| Comparative Example 1 | 55 | 210 | 95.8 | 25.6 | 0.08 | 4 | 3 | 4 | 3 |

Among them, when testing dye uptake, K/S value, dye-leveling value S, fastness to soaping and color fastness to rubbing, the data obtained by the test of the carded wool yarn and the semi-worsted yarn in the same example are consistent.

Finally, it should be noted that the above examples are only used to illustrate the technical solutions of the present disclosure, but not to limit them; although the present disclosure has been described in detail with reference to the foregoing examples, those of ordinary skill in the art should understand that: the technical solutions described in the foregoing examples can still be modified, or some or all of the technical features thereof can be equivalently replaced; and these modifications or replacements do not make the essence of the corresponding technical solutions deviate from the scope of the technical solutions of the examples of the present disclosure.

The invention claimed is:

1. A polyamide 5× staple fiber, wherein the polyamide 5× staple fiber has a denier of 8.0-30.0D, a breaking strength of 3.5-6.0 cN/dtex, an elongation at break of 62.8%-100%, a dry heat shrinkage of 3.0%-7.9% and an initial modulus of 20-42.3 cN/dtex.

2. The polyamide 5× staple fiber according to claim 1, wherein the polyamide 5× staple fiber comprises at least one of polyamide 56 staple fiber, polyamide 510 staple fiber and polyamide 512 staple fiber.

3. The polyamide 5× staple fiber according to claim 2, wherein the polyamide 5× staple fiber is derived from the product obtained by polymerization of 1,5-pentamethylenediamine and dibasic acid, followed by hot-melting and spinning.

4. The polyamide 5× staple fiber according to claim 2, wherein the polyamide 5× staple fiber is derived from the product obtained by polymerization of 1,5-pentamethylenediamine and dibasic acid, followed by hot-melting and spinning.

5. A method of preparing the polyamide 5× staple fiber according to claim 1, wherein, comprising:

1) after being ejected through a plurality of spinneret orifices of a spinneret in a spinning manifold, sequentially subjecting a polyamide 5× melt to cooling and pre-spinning treatment to obtain an undrawn yarn;

2) post-processing the undrawn yarn to obtain a polyamide 5× staple fiber;

wherein the number of the spinneret orifices ranges from 100 to 500f and a diameter of the spinneret orifices is 1.02-1.50 mm.

6. A method according to claim 5, wherein a pre-spinning speed of a pre-spinning treatment is 100-480 m/min; and/or, a cooling is performed by using a ring blower, and a wind temperature of the ring blower is 15-32° C., and/or, a wind speed of the ring blower is 0.2-1.0m/s.

7. A blended wool yarn, comprising 5-50 parts by weight of the polyamide 5× staple fiber according to claims 1, and 50-95 parts by weight of wool.

8. The blended wool yarn according to claim 7, wherein, when the blended wool yarn is a carded wool yarn, said carded wool yarn has a hank strength F1, and F1≥60N/5m; and/or, when the blended wool yarn is a semi-worsted yarn, said semi-worsted yarn has a hank strength F2, and F2≥200N/5m; and/or, a dye uptake of an acid dye of the blended wool yarn for one-bath dyeing is a, and a≥90%; and/or, a K/S value of the acid dye of the blended wool yarn for the one-bath dyeing is b, and b≥10; and/or, a dye-leveling value of the acid dye of the blended wool yarn for one-bath dyeing is S, and S≤0.2; and/or, color fastness to dry rubbing of the blended wool yarn is c1, and c1≥3, and the color fastness to wet rubbing of the blended wool yarn is c2, and c≥3; and/or, color change fastness of the acid dye of the blended wool yarn for one-bath dyeing and soaping is d1, and d1≥ grade 4, and staining fastness of the acid dye of the blended wool yarn for one-bath dyeing and soaping is d2, and d2≥ grade 3.

9. A method for preparing the blended wool yarn according to claim 7, comprising: mixing the polyamide 5× staple fiber with the wool, and sequentially subjecting the polyamide 5× staple fiber and the wool to carding, fine spinning, post-processing, and spinning, to obtain the blended wool yarn that comprises 5-50 parts by weight of the polyamide 5× staple fiber and 50-95 parts by weight of the wool.

10. A method for preparing the blended wool yarn according to claim 8, comprising: mixing the polyamide 5× staple fiber with the wool, and sequentially subjecting the polyamide 5× staple fiber with the wool to carding, fine spinning, post-processing, and spinning, to obtain the blended wool yarn that comprises 5-50 parts by weight of the polyamide 5× staple fiber and 50-95 parts by weight of the wool.

* * * * *